US008298612B2

(12) United States Patent
Jodoin

(10) Patent No.: US 8,298,612 B2
(45) Date of Patent: Oct. 30, 2012

(54) METHOD FOR DEPOSITING PARTICULATE MATERIAL ONTO A SURFACE

(75) Inventor: Bertrand Jodoin, Ottawa (CA)

(73) Assignee: University of Ottawa, Ottawa, Ontario (CA)

( * ) Notice: Subject to any disclaimer, the term of this patent is extended or adjusted under 35 U.S.C. 154(b) by 1126 days.

(21) Appl. No.: 11/913,874

(22) PCT Filed: May 8, 2006

(86) PCT No.: PCT/CA2006/000736

§ 371 (c)(1),
(2), (4) Date: Jun. 3, 2008

(87) PCT Pub. No.: WO2006/119620

PCT Pub. Date: Nov. 16, 2006

(65) Prior Publication Data

US 2008/0233282 A1 Sep. 25, 2008

Related U.S. Application Data

(60) Provisional application No. 60/678,799, filed on May 9, 2005.

(51) Int. Cl.
*B05D 1/02* (2006.01)
*B05D 1/12* (2006.01)

(52) U.S. Cl. ..... 427/189; 427/190; 427/192; 427/195

(58) Field of Classification Search ..... 427/189, 427/190, 192, 195
See application file for complete search history.

(56) References Cited

U.S. PATENT DOCUMENTS 2,714,563 A * 8/1955 Poorman et al. ..... 427/446
3,212,914 A * 10/1965 Lyle et al. ..... 427/446
4,416,421 A 11/1983 Browning
5,302,414 A 4/1994 Alkhimov et al.

FOREIGN PATENT DOCUMENTS

WO WO93/24673 A1 12/1993

OTHER PUBLICATIONS

Fujiwara, K. et al., 1999, "Thermal spray of ceramics driven by converging shock waves", Kayaku Gokkaishi, 60(4), 191-197 abstract.
Kharlamov, Yu, 1974, "Dynamic interaction of powder particles with a detonation wave", Fizika I Khimiya Obrabotki Materialov, (1), 48-53 abstract.
Wang, W., 1992, "Theoretical study of energy deposition on particle surface in dynamic compaction of tungsten powders", Xiyou Jinshu Cailiao Yu Gongcheng, 21(2), 22-8 abstract.
Kadyrov, E. et al., 1995, "Gas dynamical parameters of detonation powder spraying", Journal of Thermal Spray Technology, 4(3), 280-6 abstract.

(Continued)

*Primary Examiner* — Frederick Parker

(57) ABSTRACT

An apparatus and method are described for deposition of materials such as particulate materials onto a surface. The methods employ the use of shockwaves or compression waves to project the particulate material onto the surface as desired. This allows for the preparation of solid objects or coated surfaces that exhibit, for example, superior density and uniformity.

12 Claims, 18 Drawing Sheets

OTHER PUBLICATIONS

Semenov, S. et al., 2002, "Experiments and modelling of the deposition of nano-structured alumina-titania coatings by detonation waves", Material Science and Engineering, A: Structural Materials: Properties, Microstructure and Processing, A335 (1-2), 67-81 abstract.

Witherspoon, F. et al., 2002, "High velocity pulsed plasma thermal spray", Journal of Thermal Spray Technology, 11(1), 119-28 abstract.

Medvedev, S., 1994, "On the amplification of blast wave transmitted through a dust deposit", Proc. Int. Colloq. Dust Explos., $6^{th}$, 297-301 abstract.

Federov, A., 1985, "Acceleration wave in a gas-solid-particle mixture with accounting for melting", Prikladnaya Mekhanika I Tekhnicheskaya Fizika, (6), 111-13 abstract.

Staudhammer, K., 1999, "Fundamental temperature aspects in shock consolidation of metal powders", Powder Materials: Current Research and Industrial Practices, Proceedings of a Symposium held during the 1999 TMS Fall Meeting, Cincinnati, Ohio, Oct. 31-Nov. 4, 1999, 317-325 abstract.

Gavrilenko, T.P. et al., 1995, "Production of Metal and Metal-Ceramic Coatings on D-Gun "OB"", Proceedings of the $8^{th}$ National Thermal Spray Conference, Sep. 11-15, 1995, Houston, Texas, 51-55 abstract.

Saravanan, P. et al., 2001, "Experimental design and performance analysis of alumina coatings deposited by a detonation spray process", Journal of Physics D: Applied Physics, vol. 34, Issue 1, 131-140 abstract.

Akedo, J. et al., 2001, "Synthesis of Functional Ceramics Layers Using Novel Method Based on Impact of Ultra-Fine Particles", Shock Compression of Condensed Matter Meeting, Jun. 24-29, 2001, Atlanta, Georgia, Bulletin of the American Physical Society, vol. 46, No. 4, 1101-1104 abstract.

Schwarz, R.B. et al., 1984, "A Theory for the Shock-Wave Consolidation of Powders", *Acta metall.*, vol. 32, No. 8, 1243-1252 abstract.

* cited by examiner

METHOD FOR DEPOSITING PARTICULATE MATERIAL ONTO A SURFACE

CROSS-REFERENCE TO RELATED APPLICATION

This application is the national phase of PCT International Application Ser. No. PCT/CA2006/000736 filed May 8, 2006, and claims the priority right of Provisional Application Ser. No. 60/678,799 filed May 9, 2005 by applicants herein.

FIELD OF THE INVENTION

The present invention relates to the field of material deposition. In particular, the invention relates to methods and apparatuses for depositing particulate or powdered material in such a manner that the material forms an object or a coating.

BACKGROUND TO THE INVENTION

When an article of manufacture is created, processes such as casting, forging, etc., are used to give the material the desired shape with the sought bulk mechanical properties for the specific application. However, in many applications, the surface of the object is exposed to diverse harsh environments such as abrasive, corrosive and high temperature environments, to name a few. Those environments can degrade the surface of the object and its properties, eventually leading to its failure. Thermal spray (TS) processes are used to deposit coatings, from a few microns to a few millimeters thick, to prevent the degradation of the coated surface. TS technology is used by an increasing number of manufacturers to produce high-quality competitive products. TS encompasses a wide variety of processes that often have a common purpose: to modify the surface properties of existing objects to increase their performances and/or lifetimes. Alternatively, TS processes can allow material deposition to generate objects having a specific shape or form.

Typically, TS processes have in common that a feedstock material in powder, wire or rod form is heated to a molten or semi-molten droplet state that is preferably accelerated onto the surface to be coated. Upon impact, the particles deform, adhere to the substrate and solidify (if they were molten) building a lamellar structure to form the desired coating. The heat source to heat up or melt the feedstock particles can, for example, be a flame (resulting from the combustion of fuels) or electric arc (resulting form gas ionization). The particles are accelerated by a flow of the heated gas towards the substrate. Complete coatings may be achieved by moving the spray apparatus or the substrate relative to each other and a number of spray passes may attain the desired coating thickness.

TS processes may be used to modify or enhance the surface properties of an extensive variety of objects/surfaces of various materials by applying metallic, alloys, ceramics, polymers, cermets or carbides coatings upon them. TS coatings are used in a broad variety of industrial sectors and products such as gas and steam turbines, automotive engines, iron and steel manufactures and mills, ship and boat manufactures and repairs, chemical processing plants, electrical utilities, pulp and paper sector, defense and aerospace devices, food processing plants and mining, to name a few.

The coatings applied to the different substrates are generally grouped according to their function. Some important coating functions are: wear resistance, chemical resistance, provide thermal insulation, corrosion resistance, electrical conductivity or resistance, biocompatibility, radiative shielding, abrasive and purely cosmetic, to name a few. A coating can provide more than one function if required.

Particle temperature and velocity prior to impact is an important parameter combination determining the coating quality. Historically, TS processes have evolved towards higher particle impact velocities as they generally lead to denser coatings with improved bond strength and reduced residual stress. Previously, this has been accomplished by accelerating the propellant gas/mixture through a converging-diverging nozzle to reach supersonic velocities, to increase the propellant/particle momentum transfer. However, high particle velocities can become detrimental when the particles are fully molten prior to impact. In that case, the force exerted on the molten particle can be so large that it leads to particle breakup and/or splashing of the particles upon impact. The resulting coatings are not as dense and do not exhibit as strong bond strength. Consequently, it is customary to reduce the particle temperature as the particle velocity increases to avoid this phenomenon.

The chemical and microstructural composition of the particles prior to impact is also an important parameter affecting the coating properties and quality. Most existing TS processes lack control of the chemical composition and microstructure of the particles prior to impact due to the highly reactive propellant gas mixture into which the particles are injected to be accelerated, and optionally heated. This leads to oxidation of the particles, changes in their microstructure and/or chemical composition. Consequently, it is difficult to predict the coating chemical composition and microstructure and to tailor the feedstock material based on the required coating properties. For the same reasons, producing nanocrystalline coatings is a challenge using TS processes due to the grain growth encountered in the coating due to the heating of the particles and coatings.

Despite the widespread use of TS coatings in all industrial sectors, there is a constant demand from the manufacturers to produce higher performance and longer lasting TS coatings and objects.

SUMMARY OF THE INVENTION

It is an object of the present invention, at least in preferred embodiments, to provide a method for depositing a powdered or particulate material in such a manner that the material forms an object or a coating.

It is another object of the present invention, at least in preferred embodiments, to provide an apparatus for causing a powdered or particulate material to be deposited such that the material once deposited forms an object or a coating.

In one aspect, the present invention provides for a method for depositing a particulate material onto a surface of a substrate, such that upon or following deposition the particulate material at least in part fuses to said surface and/or to itself to form a solid mass or coating on the surface, the method comprising the steps of:

(1) placing said particulate material into a tubular member having a spraying end, and containing a gas or gas mixture;

(2) causing at least one shockwave to travel along said tubular member towards said spraying end, and out of said tubular member towards said surface, at least some of said particulate material traveling with or adjacent said shock wave and being projected onto said surface at a velocity sufficient to cause upon impact with said surface at least partial deformation of said particulate material and/or said surface and fusion with said surface and/or particulate material that has already been deposited on said surface, if present.

In another aspect the present invention provides for an apparatus for depositing a particulate material onto a surface of a substrate, such that upon or following deposition the particulate material at least in part fuses to said surface and/or to itself to form a solid mass or coating, the apparatus comprising:

a tubular member for receiving said particulate material, said tubular member having a spraying end, and containing a gas or gas mixture;

a shockwave generator for generating at least one shockwave and causing said at least one shockwave to travel along said tubular member towards said spraying end thereof, and out of said tubular member towards said surface, at least some of said particulate material traveling with or adjacent said shock wave and being projected onto said surface at a velocity sufficient to cause upon impact with said surface at least partial deformation of said particulate material and/or said surface and fusion with said surface and/or particulate material that has already been deposited on said surface, if present.

In particularly preferred embodiments of the present invention, the particulate material is heated prior to its placement into a tubular member of an apparatus of the invention.

The invention also encompasses, in other aspects, materials formed by deposition of particulate material in accordance with the methods of the invention, or using an apparatus of the invention. Such materials may take the form of a coating or partial coating on a substrate, or take the form of a near net shape.

BRIEF DESCRIPTIONS OF DRAWINGS

FIG. 1 schematically illustrates an embodiment of an apparatus of the invention prior to the generation of a shockwave.

FIG. 2 schematically illustrates an embodiment of an apparatus of the invention very shortly after the generation of a shockwave.

FIG. 3 schematically illustrates an embodiment of an apparatus of an invention shortly after the embodiment shown in FIG. 2.

FIG. 4 schematically illustrates an embodiment of an apparatus of an invention shortly after the embodiment shown in FIG. 3.

FIG. 5 presents one example of a time-position (t-x) diagram illustrating the location in time of the shock wave, contact surface, first and last expansion waves that travel inside a typical apparatus of the invention.

FIG. 6 presents one example of a velocity-time (u-t) diagram illustrating the time-dependant gas velocity inside a typical apparatus of the invention at a specific location (x2).

FIG. 7 presents one example of a velocity-position (u-x) diagram illustrating the position-dependant gas velocity inside a typical apparatus of the invention at a specific time (t2).

FIG. 8 presents one example of a pressure-position (p-x) diagram illustrating the position-dependant gas pressure inside a typical apparatus of the invention at a specific time (t2).

FIG. 9 presents one example of a temperature-position (p-x) diagram illustrating the position-dependant gas temperature inside a typical apparatus of the invention at a specific time (t2).

FIG. 10 presents a scanning electron microscopy image of an nanocrystalline aluminum alloy coating on aluminum substrate that was deposited using an apparatus of the present invention (Cu appears as a lighter grey layer, Al appears as a darker grey layer).

FIG. 11 presents a scanning electron microscopy image of a nanocrystalline aluminum alloy coating on aluminum substrate that was deposited using an apparatus of the present invention.

FIG. 12 presents a scanning electron microscopy image of a copper coating on aluminum substrate that was deposited using an apparatus of the present invention (Cu appears as a lighter grey layer, Al appears as a darker grey layer).

FIG. 13 presents a scanning electron microscopy image of a copper coating on aluminum substrate that was deposited using an apparatus of the present invention.

Figure 16:
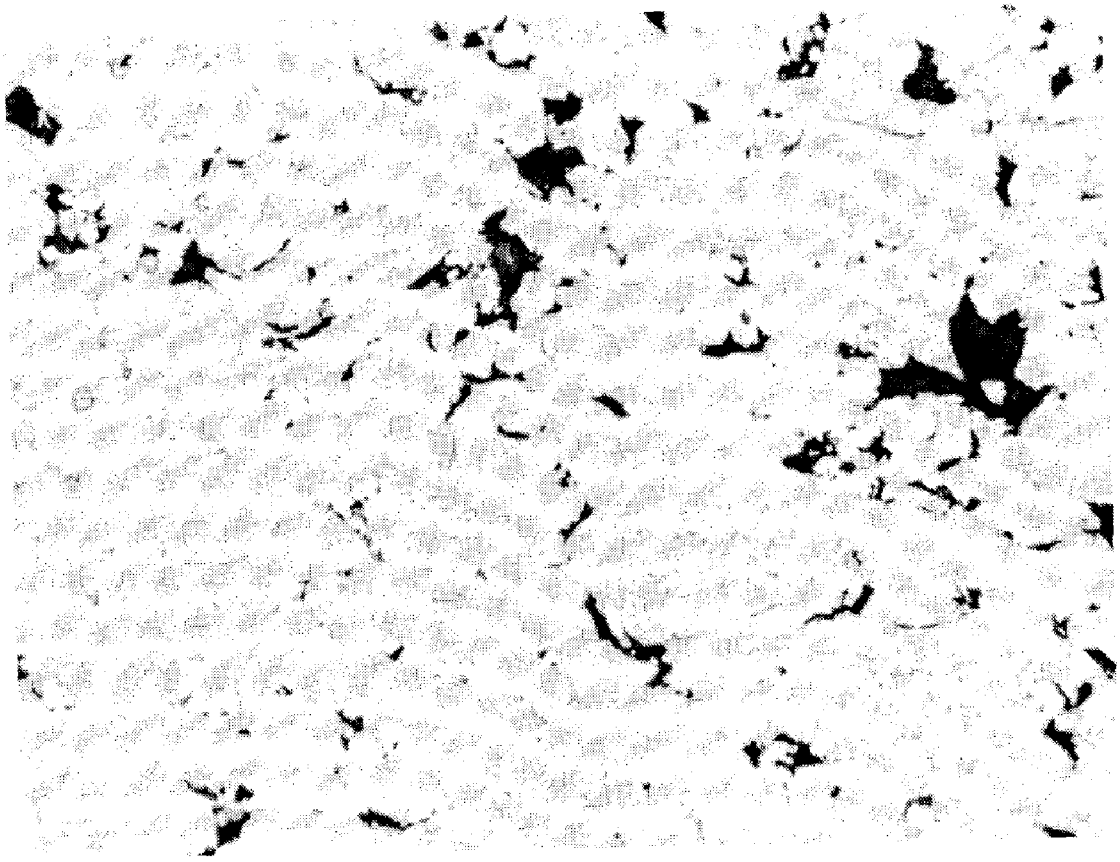

FIG. 16 presents a scanning electron microscopy image of an nanocrystalline aluminum alloy coating that was deposited using an apparatus of the invention.

Figure 17:
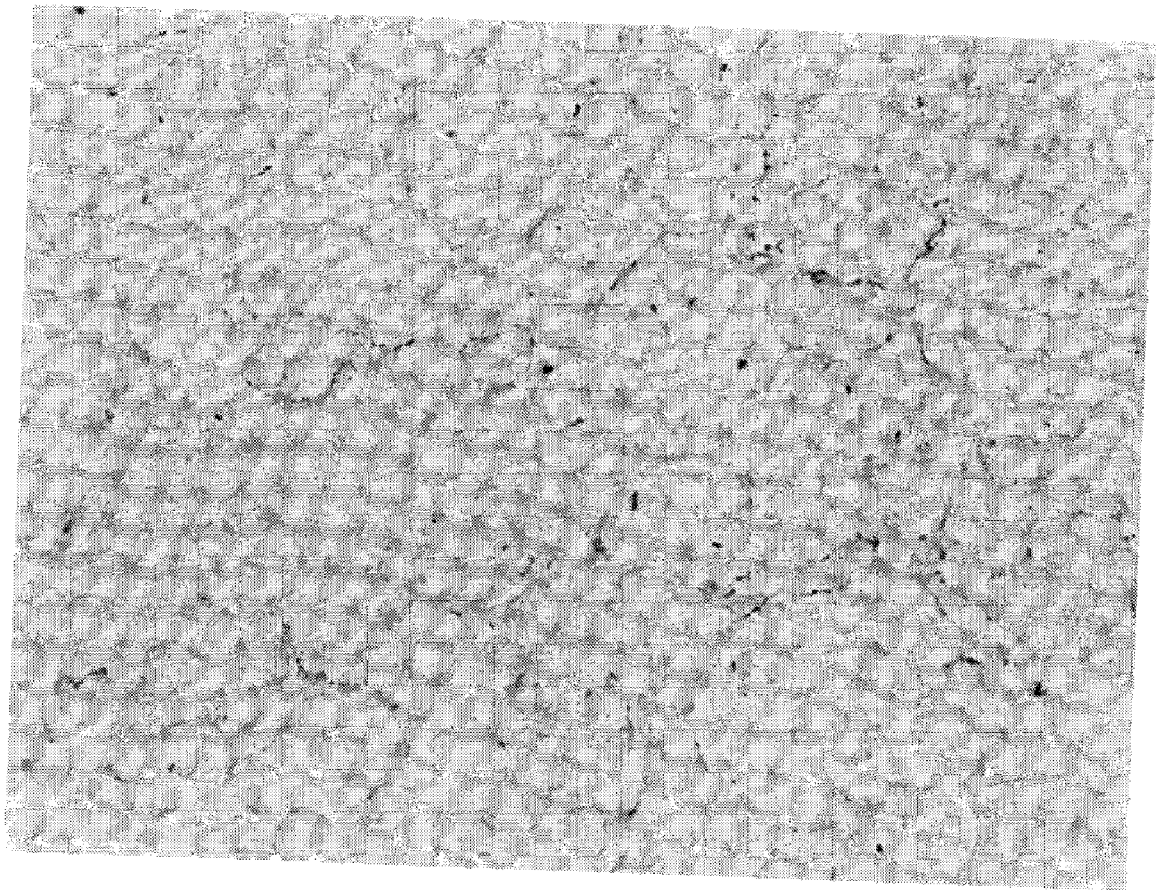

FIG. 17 presents a scanning electron microscopy image of an nanocrystalline aluminum alloy (Al-12Si) coating that was deposited using an apparatus of the invention.

Figure 18:
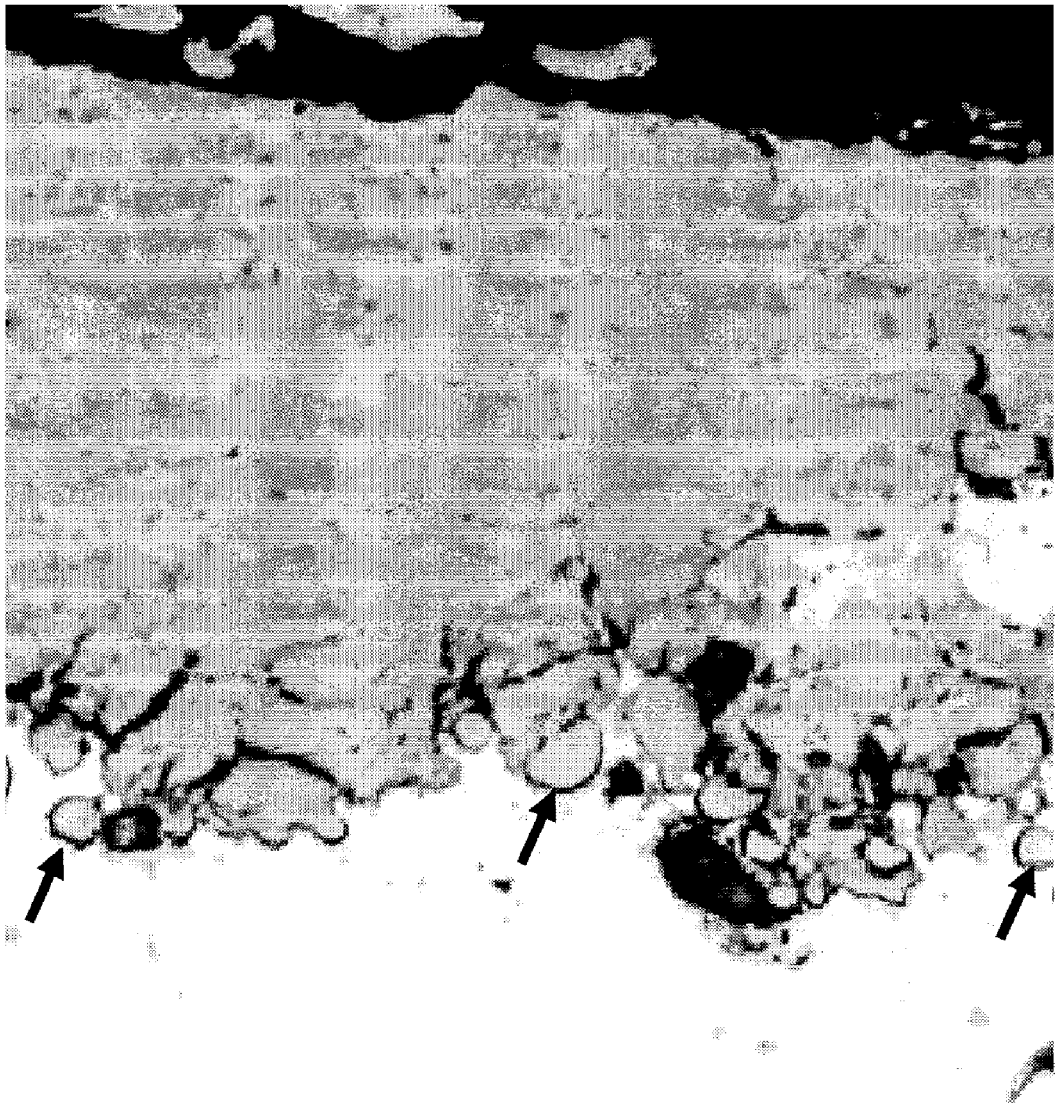

FIG. 18 presents an optical microscope image of a stainless steel coating produced form amorphous stainless steel powder on an aluminum 6061 substrate surface. The stainless steel powder was pre-heated prior to insertion into the spraying gun to 350-400° C. Arrows indicate stainless steel particles that are embedded or partially embedded into the substrate upon impact with little or no deformation.

DEFINITIONS

Coating: refers to any partial or complete covering on a surface of a substrate that is achieved in accordance with the methods of the invention. Preferably, once formed, the coating is substantially unyielding at least in that is does not easily rub or otherwise come away from the surface by hand manipulation of the substrate.

Coldspray: refers to selected methods of the present invention and those of the prior art that involve insufficient heating of particulate material to cause even partial melting of the particulate material prior to acceleration and projection of the material for deposition onto a surface. Typically, for example, coldspray techniques rely upon the deformation of the particles of the particulate material and/or the substrate to cause some degree of fusion between the particulate material and/or the substrate (rather than induction of said particulate material to adopt a molten state through heating prior to impact of said particles with one another and/or a surface of a substrate).

Compression wave: refers to any form of wave, typically a wave of lower energy than a shockwave, that is formed by a shockwave generator and is suitable to coalesce with other compression waves, preferably in an organized fashion, to form a shockwave. Such compression waves a typically formed when a pressure in a shockwave generator is released or when a shockwave is generated by a chemical or explosive reaction.

Fuse/fuses: refers to adherence of materials when brought into contact with one another, with particular reference to the adherence of particles of material when projected towards a substrate in accordance with the present invention, to one another or to the surface of the substrate. Such fusing may involve, but is not limited to, mechanical bonding and/or metallurgical bonding. Typically, such particles and/or the substrate may undergo at least partial deformation upon impact therebetween.

Near-net shapes: refers to an object having a specific three-dimensional shape generated by layering material deposited in accordance with selected methods of the invention and/or using selected apparatuses of the present invention. Powder/particulate material/feedstock powder: these terms are interchangeable and refer to any material in powdered/particulate form that is suitable for use in connection with the methods and apparatuses of the present invention to form an object or a coating when subjected to methods as discussed herein.

Preferably: unless stated otherwise the use of the term "preferably" refers to preferred features of only the broadest embodiments of the invention.

Propellant gas mixture/gas/gas mixture: can include a single gas substantially free of other gases or materials, or alternatively may comprise a mixture of various gases as required. Preferably the gas or gases are substantially inert to the particulate material and/or the apparatus of the present invention during the methods of the invention at all ranges of temperature and pressure conditions.

Quiescent: refers in the context of the present application to quiescent gas, which is any gas or gas mixture through which a shockwave in accordance with the teachings of the present application is not presently traveling. A quiescent gas may otherwise include any internal fluid motion, temperature, or other properties of a gas within a confined space, with the exception that a shockwave absent. Upon passage through the gas of a shockwave, a gas may return to a quiescent state, or a partially quiescent state, prior to passage therethrough of another shockwave.

Shockwave: refers to a shockwave generated by any device such as a shockwave generator suitable to cause motion of particulate material in a tubular member for example towards a spraying end of the tubular member. In other alternative embodiments of the methods or apparatuses of the invention, the shockwave may be generated by a chemical or explosive reaction. Typically, but not necessarily, shockwaves result from the accumulation and coalescence of compression waves generated by a shockwave generator. In accordance with the apparatus of the present invention, such coalescence may occur for example, in a shockwave generator, between a shockwave generator and a tubular member, or within a tubular member following passage into the tubular member of compression waves. In selected embodiments, the passage of a shockwave for example along a tubular member may increase a pressure and temperature of a gas/gas mixture in the tubular member, for example by as much as a few ° C. and kPa or more.

Shockwave generator: refers to any device that is capable of generating one or more shockwaves, or that is capable of generating a plurality of compression waves suitable to coalesce into one or more shockwaves. Such a device may for example comprise some form of chamber containing a gas or gas mixture, and means to increase the pressure of the gas or gas mixture in the chamber. Upon release of such pressure, a shockwave (or at least compression waves suitable to form a shockwave) are generated and released. In one example, the compression waves may enter a tubular member of the apparatus of the invention and subsequently coalesce in the tubular member to form a shockwave that travels the length of the tubular member. However, such a shockwave may be formed, at least in preferred embodiments, prior to entry into the tubular member of any form of wave, and may be generated directly by the shockwave generator. A shockwave generator may also, in selected embodiments, encompass means to cause a chemical or explosive reaction suitable to generate a shockwave.

Solid mass: refers to any three-dimensional object generated by material deposition in accordance with the methods of the present invention.

Spray/spraying: refers to projection of particulate material from an apparatus of the present invention. Such spraying may encompass any form of particle ejection from the apparatus either in a highly directed and focus manner or in a relatively random manner. Spraying also encompasses embodiments of the invention where the apparatus of the invention, or at least a spray gun of the apparatus of the invention, moves relative to a substrate or a surface of a substrate.

Substrate: a body having a surface onto which material is deposited in accordance with the methods of the invention to provide a coating to the surface or a foundation for the production of a solid mass such as a near-net shape. The body may comprise a material that is different or the same as material being deposited onto the surface. Moreover, the body may optionally include or exclude a surface layer of material that has already been deposited on a surface of the body.

Surface: refers to a surface of a substrate or a surface comprising material that has been deposited in accordance with the present invention. Moreover, the surface of a substrate may include a surface of a material of the substrate, but may also include a surface of particulate material that has already been deposited on the material of the substrate.

Tube/tubular member: refers to any member having a configuration suitable for passage of shockwaves therethrough with the intention of accelerating, and optionally heating, particulate material and/or a gas or gas mixture within the tube in a manner suitable for deposition onto a surface in accordance with the teachings of the invention. The tube may be straight or bent, may have a uniform or non-uniform cross sectional area/lumen, may have a circular/square/any other cross-sectional configuration, and may be comprised of any material including but not limited to metal/plastic/polymer/resin/alloy etc. The expression tubular member encompasses all references to a barrel, tube, gun barrel, spraying gun, gun etc. Typically, although not necessarily, a tubular member will include a spraying end from which particulate material will be projected with shock waves emanating therefrom. In addition, an end of a tubular member opposite a spraying end may preferably be attached to a shockwave generator. Either or both of the spraying end or the end opposite the spraying end (adjacent a shockwave generate) may include a valve. For example, in selected embodiments, pressure may be raised in a shockwave generator relative to a pressure in a tubular member, and opening of a valve between the tubular member and the shockwave generator may cause a shockwave to be generated and pass from the shockwave generator along the tubular member. In other embodiments, a valve may be present at both ends of the tubular member, which can each be selectively opened and/or closed as desired. In this way, the internal conditions of the tubular member (gas consistency, particulate material, pressure, temperature etc.) may be regulated prior to the generation and passage of a shockwave therethrough, and both valves may be opened simultaneously (or nearly simultaneously) when the shockwave is generated, thereby to allow ejection of the particulate material from the spraying end of the tubular member. In selected embodiments, a tubular member may further include some form of inlet for use in placing particulate material therein at or prior to passage through the tubular member of a shockwave. More preferably, the particulate material is placed into the tubular member just prior to passage therethrough of a shockwave.

Unyielding: refers to a property of a coating or solid mass generated by the deposition of particulate material in accordance with the methods of the present invention. The term unyielding is intended to differentiate the nature of the coating or solid mass from that of a particulate material, which will tend to flow if influenced to do so by gravity or another external force. In contrast, the coatings or solid masses generated in accordance with the present invention comprise particulate material that has at least partially fused together and/or fused with a surface of a substrate, such that the material is generally incapable of flow upon application thereto of a small external force.

DETAILED DESCRIPTION OF THE PREFERRED EMBODIMENTS

This invention relates to Thermal Spray (TS) processing for applying high performance, resilient coatings on existing surfaces and also relates to near-net shape manufacturing for creating high performance, resilient shaped objects. In preferred embodiments, the invention relates to a new method and apparatus for simply and efficiently accelerating, and optionally heating, powder particles towards a substrate. The optional heating may occur, for example, when the shockwave interfaces or drives the motion of the powder particles. The new method and apparatus allow for particle velocity and temperature ranges that result in less degradation of the powder due to the non-reactive nature of the propellant gas mixture used and/or to the mechanical means used to accelerate the propellant gas mixture used. The velocity and temperature ranges attainable, as well as the superior control of the chemical composition and microstructure of the particles prior to impact on substrates can result in higher quality coatings or near-net shapes compared to those achievable by the methods of the prior art. This invention further encompasses the use of a shockwave generator to produce moving shockwaves that create the velocity and temperature of an initially quiescent gas. This flowing gas is then used to accelerate, and optionally heat, the powder particles to a desired impact velocity and temperature.

The methods of the present invention encompass the generation of a shockwave or compression waves that coalesce into a shock wave and forcing its passage into a spraying gun containing the feedstock powder in a quiescent gas.

In selected embodiments, the present invention uses compression waves that are directed through a spraying gun containing a quiescent gas. The compression waves travel into the gun and coalesce into a shock wave that moves towards the exit of the spraying gun. The passage of the shock wave in the spraying gun induces the flowing and optionally heating of the initially quiescent gas behind. This gas flow is used to accelerate, and optionally heat, feedstock materials that were initially present in the spraying gun towards a substrate. Preferably, this process is repeated in a cyclic manner at a predetermined frequency. Moreover, the spraying gun and the surface to be coated may be moved relative to one another thereby to cause spraying over a larger surface area.

As discussed, the passage of the shockwave may or may not cause heating of the particulate material in the spraying gun. Preferably, any heating of the particulate material will be insufficient (or at least substantially insufficient) to cause even partial melting of the particulate material. In this way, the particulate material will be ejected from the spraying gun in substantially solid form, and deform and/or fuse upon impact with a surface of the substrate. In selected embodiments, the methods of the invention encompass the use of a pre-heating step, to pre-heat the particulate material prior to passage of the shockwave or even prior to entry of the particulate material into the spraying gun. This pre-heating causes the temperature of the particulate material to be raised relative to ambient temperature, but preferably the pre-heating is insufficient to cause the particulate material to melt or partially melt. Typically, such pre-heating of the particulate material may heat the particulate material to from 20° C. to 1200° C., although the pre-heat temperature may vary even beyond this range depending upon the application, and the nature of the particulate material and/or the substrate onto which it is being deposited. In some embodiments, pre-heating may be required to ensure a ductility or malleability of the particulate material to a degree sufficient to allow deformation and/or fusion of the material upon impact with a surface. Such embodiments will be described in more detail with reference to the Examples. Preferably, any pre-heating of the particulate material will cause an increase in temperature of the particulate material during, and following injection of the particulate material into the spraying gun, during passage through the spraying gun, and ejection of the particulate material from the spraying gun and onto the substrate. For example, the particulate material may be pre-heated before injection into the spraying gun, and then subjected to a shockwave almost immediately after injection into the spraying gun, such that the particulate material does not have time to cool to any significant degree prior to ejection from the spraying gun. In other embodiments, the gas(es) in the spraying gun may be preheated, and this may be sufficient to confer sufficient heat to the particulate material during time in or passage through the spraying gun to confer the necessary qualities of ductility or malleability.

The methods of the present invention may be conducted with any suitable apparatus, involving any means for generating one or more shockwaves, and any means of using those shockwaves to project particulate material as desired onto a surface. Although the invention will be further described with reference to specific apparatuses, and components thereof, such apparatuses and components thereof in no way limit the scope of the methods of the invention.

Spraying Gun

The configuration of the spraying gun may vary significantly. For example, the spraying gun may comprise a tube or barrel of circular, rectangular, square or any required cross-sectional shape suitable to achieve the desired spray characteristics. Preferably, the internal shape of the barrel may be adapted to the pieces to be sprayed on or the shape of the desired coatings or solid objects to be formed. The cross-section of the spraying gun is preferably uniform but in specific embodiments it may vary along the length of the gun, for example to compensate for aerodynamics effects such as the boundary layer effect along the gun length.

At the beginning of the process, the spraying gun may, at least in selected embodiments, be closed at one end (the gun inlet) and opened at the other end (the gun exit) and is filled with a quiescent gas. The gas is preferably an inert gas such as helium or nitrogen or a mixture of both, although other gases and mixtures may also be used. A certain amount of the feedstock material is also present inside the gun at or near the beginning of the process, preferably near the gun inlet.

A device such as a valve then causes the gun inlet to open and allow a shockwave or compression waves to enter into the gun. These waves travel towards the exit of the gun and if necessary coalesce to form a shock wave that travels towards the exit of the gun. The passage of this shock wave in the spraying gun induces the flowing and heating of the initially quiescent gas behind it. This gas flow then accelerates (and preferably heats) the feedstock materials along at least part of the length of the barrel, to exit the gun at the gun exit, and towards a substrate. Upon impact with the substrate, the feedstock material at least partially deforms and/or at least partially deforms the substrate material depending on its impact velocity and temperature. In this way the feedstock material adheres to the substrate. Without wishing to be bound by theory, this adherence is most likely to involve mechanical bonding and/or metallurgical bonding, thereby to form a coating.

In preferred embodiments, the gas or gas mixture in the barrel or tubular member returns at or near to a quiescent state, or returns at or near to atmospheric pressure, between successive shockwaves.

This Process is Preferably Repeated in a Cyclic Way at a Predetermined Frequency.

In preferred embodiments of the invention, the spraying gun is such that the previously described process can be repeated in a cyclic manner, preferably at a predetermined frequency. For example, to assist in this regard the spraying gun may be made of materials that: are able to sustain the pressure and temperature experienced by the gas inside the gun; and will minimize reaction with the gas and feedstock materials. The length of the spraying gun may be varied depending on the feedstock particles to be accelerated and the required particle impact velocity and temperature to obtain the required coating and coating properties. Preferably, the length of the spraying gun may vary from 1 cm to 2 m. The spraying gun can be bent if required by the application.

Powder Injection

Preferably, the feedstock powder can be injected inside the spraying gun, near the inlet, by mechanical means such as a powder feeder similar or identical to the ones used in thermal spray processes while the gas in the spraying gun is quiescent or close to quiescent, prior to the passage of the shock wave. A valve closes the passage between the powder feeder and the spraying gun when the shock wave is "injected" into the gun barrel (or when compression waves are injected which coalesce into a shockwave), and while the feedstock powder is accelerated towards the substrate. This valve opens after the pressure inside the gun reaches the ambient pressure level or close to it. Then, in the case of a cyclic process (i.e. pulses of shockwaves) another load of powder is injected in the gun before the passage of the next shock wave. Preferably, the feedstock powder is injected under pressure into the lumen of the spraying gun. This is especially useful if, between shockwaves, the internal pressure of the spraying gun does not reduce to at or near atmospheric pressure, or an external pressure of the environment surrounding the apparatus.

The quiescent gas inside the spraying gun can be preheated. An electric heater to avoid any gas contamination is preferably used to preheat the gas.

The particulate material may, in preferred embodiments, be injected into a spraying gun just prior to passage therethrough of a shockwave.

Compression Wave Generator

The shockwaves or compression waves are preferably generated by a compression wave generator connected to the spray gun inlet by a valve. Prior to the valve opening, the generator is filled with a gas, preferably an inert gas such as helium or nitrogen or a mixture of both, although other gases and mixtures may be used. The gas in the compression wave generator is preferably at a pressure above 150 kPa and preferably at a temperature above 0° C. The generator may be a tube, a flexible hose or other containers, as long as they can sustain the pressure and temperature of the gas. The flexible hose can also be used as long as it can sustain the pressure and temperature of the gas. The shock is generated by filling this shock generator with the gas, at a pressure preferably between 200 kPa and 20 MPa, and preferably at a temperature between 20° C. and 1200° C.

Once the generator is filled with the gas at the desired pressure and temperature, the valve connecting the generator and the spraying gun is opened swiftly, creating at the interface between the generator and the spraying tube, thereby causing compression waves to move away from the generator, and travel in the quiescent gas in the spraying tube towards the end of the spraying tube. Preferably, those compression waves coalesce to form the shock wave that induces flowing of the gas, behind it, in the spraying gun.

At the same time, expansion waves are also created at the generator/gun interface and propagate in the generator, reducing the gas pressure inside the generator.

Once the particles that were loaded into the spraying gun have impacted the substrate (or shortly before the particles impact the substrate), the valve connecting the shock generator and the spraying gun is closed and the shock generator is filled up again by high pressure gas while new solid particles are introduced in the spraying gun and the operation can be repeated if desired, in a cyclic pattern to build up the coating.

In preferred embodiments, the gas inside the generator can be preheated. An electric heater to avoid any gas contamination is preferably used to preheat the gas. The opening and closing of the valves are preferably automated, with the frequency based on the parameters of the operating parameters and dimensions of the spraying gun and generator.

Coatings to be applied using the present invention, at least in preferred embodiments, are expected to be denser, harder, more uniform, have lower residual stress, have higher bond strength and exhibit less oxidation, chemical and/or microstructural changes with respect to the initial feedstock powder than coatings applied using existing thermal spray apparatuses and methods. The processes of the invention allow a non-reactive gas/mixture propellant reach a high velocity and intermediate temperature simultaneously (in the 500-1500 m/s and 20° C.-1200° C. range). This temperature range and the non-reactive environment during flight lead to improvements in the coating quality.

Without wishing to be bound by theory, the apparatuses and methods as described herein provide, at least in preferred embodiments, the following specific features compared to selected methods and apparatuses of the prior art:

1—The apparatus involves simple spraying gun geometry, e.g. no converging/diverging nozzle required to reach high gas velocity and consequently the apparatus is simpler and cheaper to design and manufacture.

2—The is the possibility to use various spraying gun cross-sections (round, square, rectangular, elliptical, etc.) according to the application.

3—No (or at least reduced) clogging of the feedstock particle inside the spraying gun since there is no converging section and consequently longer spraying time is possible without interruption, thereby improving productivity.

4—Due to the simple gun geometry, the spraying gun section can be changed easily in a few seconds to accommodate for the requirement of longer acceleration zone for certain type of materials or for different operating parameters.

5—Due to the simple geometry of the spraying gun, it can be bent easily to allow to spray inside diameters, or awkward to reach surfaces.

6—Injection of the feedstock is preferably done between two shock wave passages, when the pressure at the injection location in the spraying gun is back to or close to atmospheric pressure. Consequently, simple and cheap powder feeding system may be used.

7—Due to the transient nature of the gas flow, near optimization of the gas usage to accelerate the particles can be achieved, resulting in lower operating costs.

8—High deposition efficiencies have been recorded (above 70%).

9—Possibility to spray ceramics since high gas temperature can be achieved after the shock wave passage if the gas is preheated.

10—The particles are exposed to a quasi constant velocity flow since the gun is not a converging-diverging nozzle (neglecting the boundary layer effect), maximizing the momentum transfer to the particles.

11—The particles are exposed to a quasi constant temperature flow since the gun is not a converging-diverging nozzle (neglecting the boundary layer effect), maximizing the heat transfer to the particles.

12—Possibility to preset the temperature to which the particles will be exposed during their acceleration by setting the initial quiescent gas temperature and/or preheating the particulate material prior to passage of the shockwave or prior to entry into a tubular member of an apparatus of the invention.

13—Less noisy method than many of those of the prior art.

14—Under specific embodiments, little or no heating of the substrate may be required.

15—Potential for true metallurgical bonding rather than just mechanical bonding

16—No combustible gases increase the safety of the apparatus and methods of the invention.

17—No vacuum system needed.

Features shared with Cold Spray apparatuses and methods of the prior art (where the initial gas temperature is kept below the feedstock material melting or softening temperature):

1—No melting or softening of the feedstock material consequently no chemical and/or phase change. Possibility to spray nanocrystalline materials, metastable materials and temperature sensitive materials due to lack of grain growth.

2—Little or no oxidation of the coating and substrate if nitrogen or helium is used.

3—Recycling of the powder that did not adhere to the substrate is possible.

4—Near-net shaping is possible.

5—Little or no over spray so masking can be reduced to a minimum or is not required 6—Minimal surface preparation is needed.

7—Highly machinable coatings can be created.

8—Uniform microstructure of coatings

9—Minimal residual stresses

10—No toxic gases or chemical reactions

11—Wide range of coatings (Cu, Al, Zn, Fe, Al alloys, cermets, etc)

12—Potential elimination of grit blasting prior to spraying due to high impact velocity 13—High velocity allows high quality coatings at greater spray angle 14—Reduced substrate heating 15—Advanced operating modes include the use of multiple powder feed ports for multiple powder types fed in alternating sequences from one pulse to the next, allowing to produce functionally graded coatings 16—High density of the coatings 17—High thermal and electrical conductivity of coatings 18—Highly wrought microstructure—high hardness 19—Follow substrate contour very well These and further and other advantages and features of the invention will be apparent to the skilled person upon a review of the entire disclosure. As will be appreciated, this invention is amenable to other and different embodiments, and its several details are capable of modification in various obvious respects, all without departing from the invention. Accordingly, the following Examples, and the drawings and descriptions are to be regarded as illustrative and not restrictive in nature.

EXAMPLES

Example 1

Induced Gas Velocity and Temperature in a Spraying Gun of an Apparatus of the Invention after the Passage of a Shock Wave The following tables present the induced gas velocity and temperature in a spraying gun of an apparatus of the invention after the passage of a shock wave, as a function of the initial pressure and temperature inside the shock generator. In Tables 1 and 3 helium is used while in Tables 2 and 4 nitrogen is used. The table of predicted results are on the basis of the one-dimensional Gas Dynamics theory that is well known in the art.

TABLE 1

| Initial Gas Pressure Inside Shock Generator (MPa) | Initial Gas Temperature Inside Shock Generator (° C.) | Induced Gas Velocity in Spraying Gun (m/s) | Induced Gas Temperature in Spraying Gun (° C.) |
|---|---|---|---|
| 1 | 20 | 685 | 180 |
| 1 | 100 | 770 | 304 |
| 1 | 400 | 1060 | 768 |
| 1 | 800 | 1262 | 403 |
| 3 | 20 | 995 | 282 |
| 3 | 100 | 1121 | 434 |
| 3 | 400 | 1613 | 670 |
| 3 | 800 | 2013 | 815 |
| 5 | 20 | 1132 | 336 |
| 5 | 100 | 1373 | 454 |
| 5 | 400 | 1872 | 821 |
| 5 | 800 | 2400 | 1093 |

TABLE 2

| Initial Gas Pressure Inside Shock Generator (MPa) | Initial Gas Temperature Inside Shock Generator (° C.) | Induced Gas Velocity in Spraying Gun (m/s) | Induced Gas Temperature in Spraying Gun (° C.) |
|---|---|---|---|
| 1 | 20 | 281 | 146 |
| 1 | 100 | 332 | 174 |
| 1 | 400 | 432 | 235 |
| 1 | 800 | 512 | 293 |
| 3 | 20 | 420 | 227 |
| 3 | 100 | 502 | 285 |
| 3 | 400 | 675 | 434 |
| 3 | 800 | 821 | 590 |
| 5 | 20 | 480 | 270 |
| 5 | 100 | 579 | 347 |
| 5 | 400 | 794 | 560 |
| 5 | 800 | 983 | 796 |

Improved theoretical modeling studies using one-dimensional Gas Dynamics theory involving well known laws of fluid dynamics allowed for the generation of more accurate predictions regarding Tables 1 and 2. These improved modeling studies are shown as Tables 3 and 4 below.

TABLE 3

| Initial Gas Pressure Inside Shock Generator (MPa) | Initial Gas Temperature Inside Shock Generator (° C.) | Induced Gas Velocity in Spraying Gun (m/s) | Induced Gas Temperature in Spraying Gun (° C.) |
|---|---|---|---|
| 1 | 20 | 685 | 180 |
| 1 | 100 | 737 | 197 |
| 1 | 400 | 869 | 239 |
| 1 | 800 | 976 | 468 |
| 3 | 20 | 995 | 282 |
| 3 | 100 | 1079 | 315 |
| 3 | 400 | 1297 | 406 |
| 3 | 800 | 1480 | 493 |
| 5 | 20 | 1132 | 336 |
| 5 | 100 | 1233 | 378 |
| 5 | 400 | 1495 | 500 |
| 5 | 800 | 1720 | 621 |

TABLE 4

| Initial Gas Pressure Inside Shock Generator (MPa) | Initial Gas Temperature Inside Shock Generator (° C.) | Induced Gas Velocity in Spraying Gun (m/s) | Induced Gas Temperature in Spraying Gun (° C.) |
|---|---|---|---|
| 1 | 20 | 286 | 135 |
| 1 | 100 | 307 | 146 |
| 1 | 400 | 359 | 229 |
| 1 | 800 | 401 | 557 |
| 3 | 20 | 420 | 212 |
| 3 | 100 | 455 | 234 |
| 3 | 400 | 542 | 298 |
| 3 | 800 | 615 | 441 |
| 5 | 20 | 484 | 254 |
| 5 | 100 | 524 | 284 |
| 5 | 400 | 629 | 370 |
| 5 | 800 | 719 | 454 |

Example 2

Practical Generation and Motion of a Shock Wave in Accordance with an Apparatus of the Present Invention Without wishing to be bound by theory, the inventor has earnestly studied the reasoning behind the features presented by the apparatuses and methods of the present invention, as discussed below.

Figure 1:
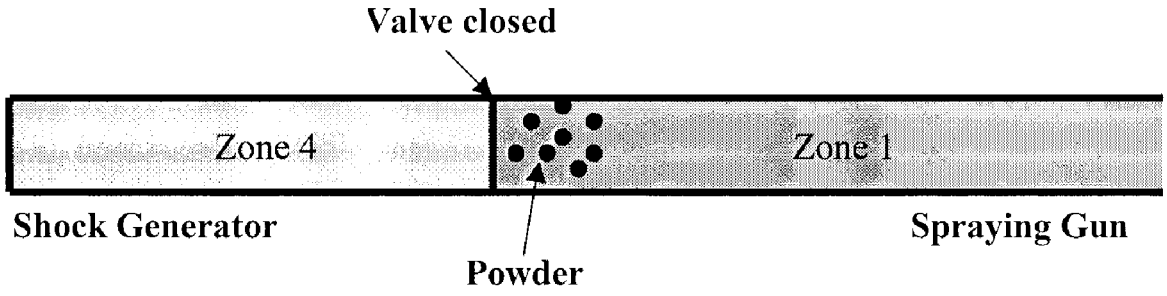

With reference to FIG. 1, the gas initially in the gun (Zone 1) and the gas initially in the shock generator (Zone 4) can be of different nature and at different temperatures. The gas in Zone 1 is at a lower pressure (usually atmospheric pressure or lower) than the gas in Zone 4, which is usually at a pressure above atmospheric pressure.

Figure 2:
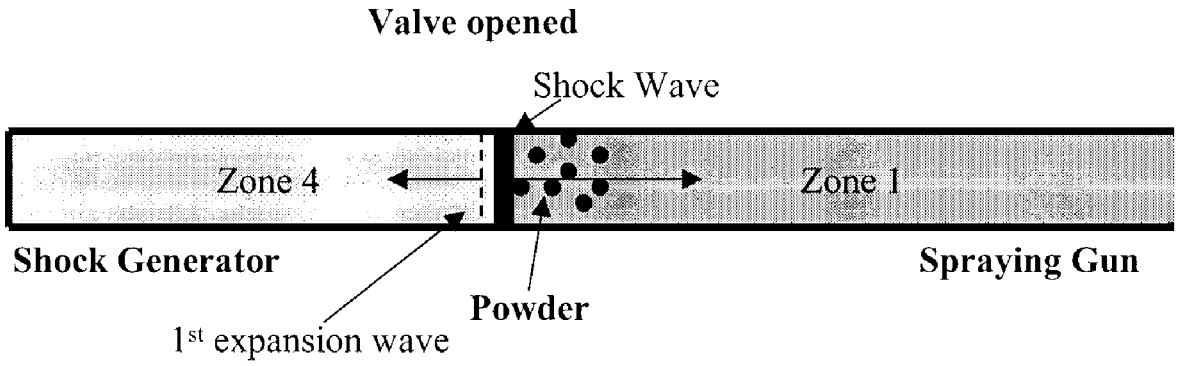

With reference to FIG. 2, when the valve is rapidly opened, a shock wave is generated as a result of the coalescing compression waves emitted at the interface between Zone 1 and 4. This shock wave propagates into the quiescent gas in the spraying gun. At the same time, expansion waves can be generated and emitted at the interface between Zone 1 and 4. Those waves do not coalesce but rather travel all separately into the quiescent gas in the shock wave generator.

Figure 3:
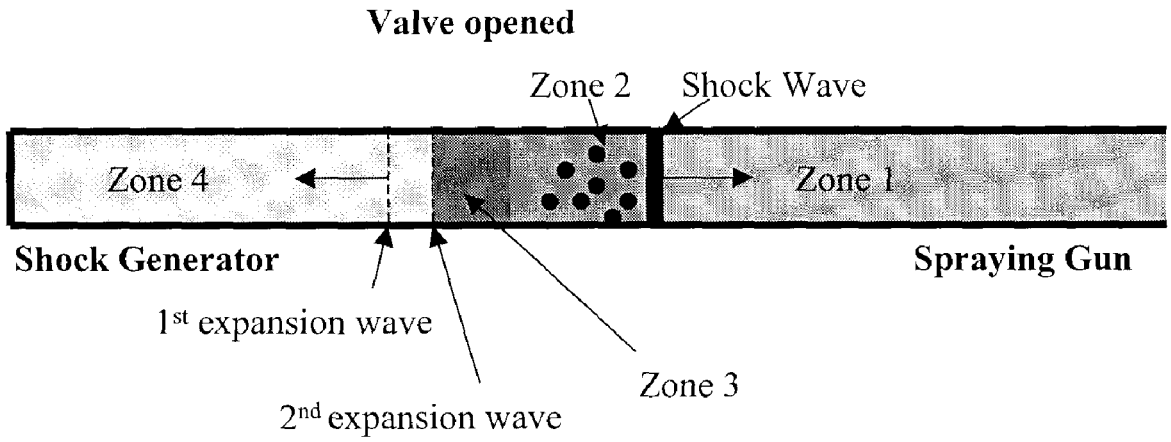

With reference to FIG. 3, the shock wave travels to the right in the quiescent gas in Zone 1 in the spraying gun. The shock wave velocity depends on the initial pressure ratio between Zone 1 and 4 and initial temperatures in Zone 1 and 4. Its passage increases the pressure and temperature of the gas behind it (Zone 2) and induces a gas velocity to the right, behind the shock wave.

The interface between the gas that was initially in the spraying gun and the gas that was initially in the shock wave generator is called the contact surface and it also moves to the right, but at a velocity slower than the gas in Zone 2. The contact surface separates Zone 2 (containing the gas initially in the spraying gun that has been accelerated by the shock wave) and Zone 3 (containing the gas that was initially in the shock wave generator and that has been expanded through the expansion waves). Although the entropy changes discontinuously through this interface, the pressure in zone 2 and 3 may be similar if not identical.

Figure 4:
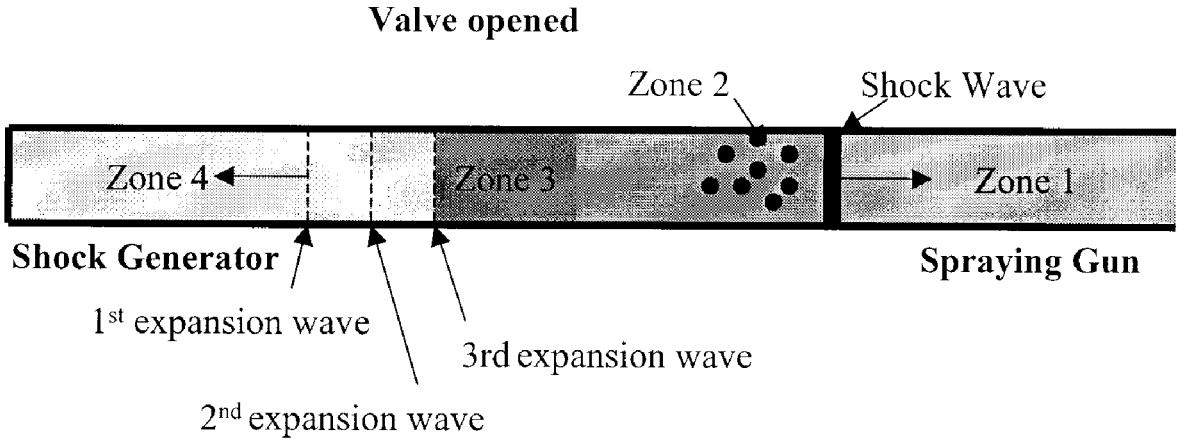

With reference to FIG. 4, the expansion waves are generated and propagated continuously in Zone 4, decreasing smoothly the pressure in Zone 4 to the lower value behind the expansion wave, in Zone 3.

Example 3

Analysis of Gas Conditions within the Apparatus of the Invention

The strength of the generated shock wave, and consequently the induced gas velocity and temperature in the four Zones, is principally determined by the initial gas conditions in the spraying gun and the shock wave generator. Without wishing to be bound by theory, the inventors have applied basic theory of gas dynamics to the methods of the present invention to consider the conditions within an apparatus of the invention during shockwave generation, passage of the shockwave through the apparatus of the invention, and projection of particles onto a substrate.

Figure 5:
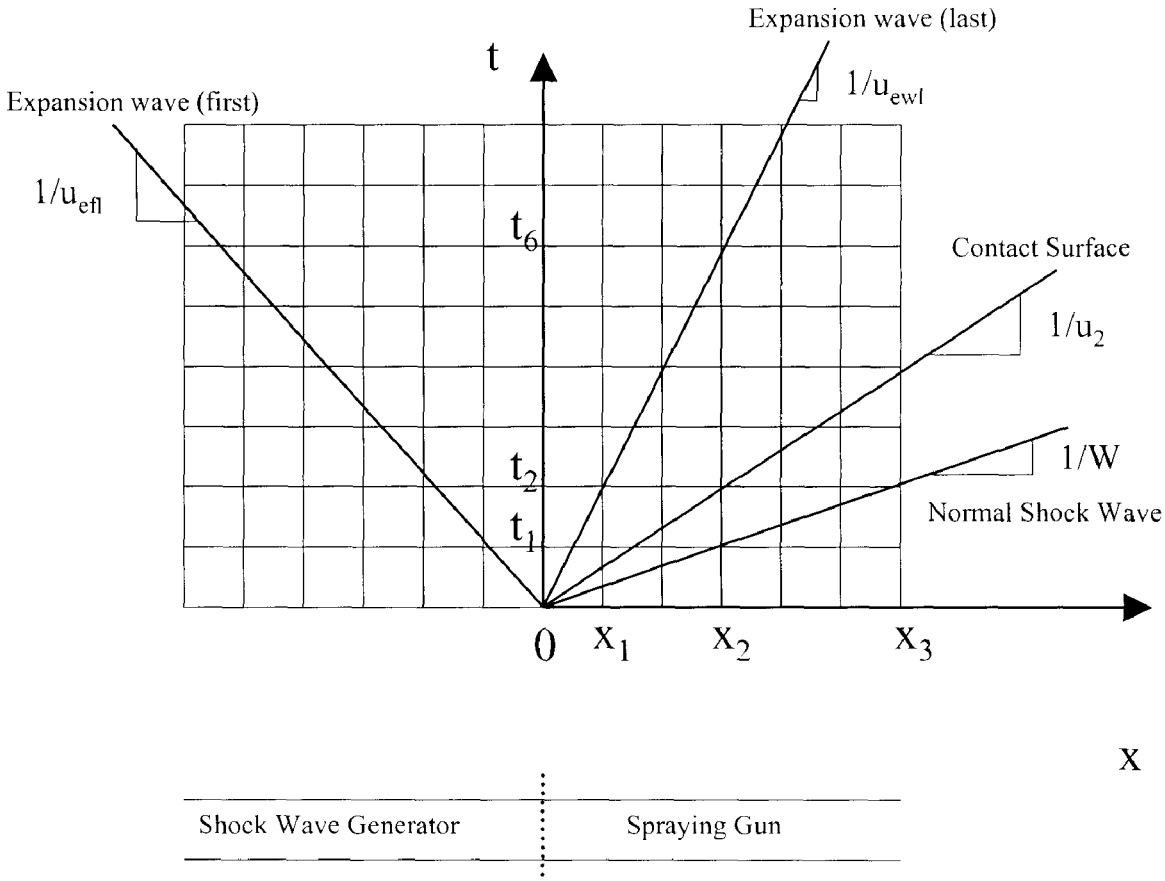

FIG. 5 present one example of a time-position (t-x) diagram schematically illustrating the location in time of the shock wave, contact surface, first and last expansion waves that travel inside the apparatus of the present invention.

Figure 6:
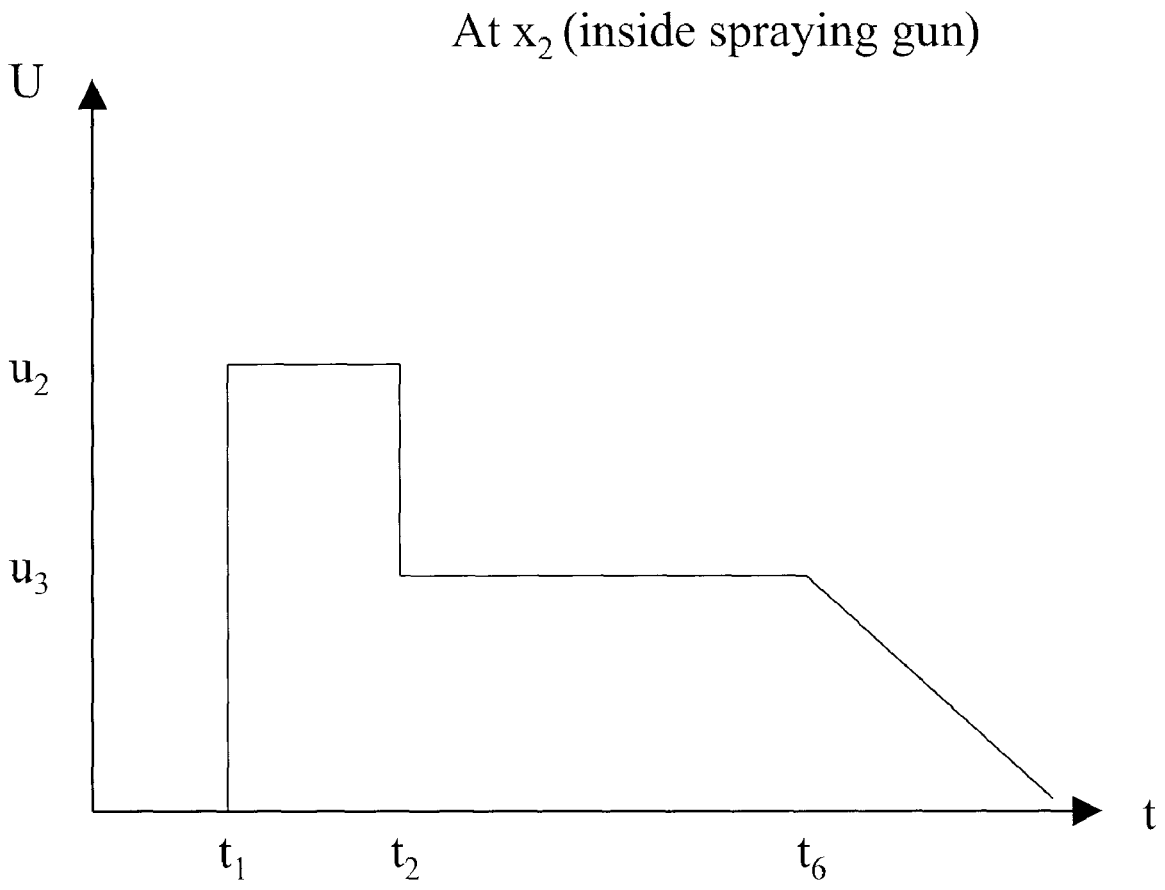

FIG. 6 presents one example of a velocity-time (u-t) diagram schematically illustrating the time-dependant gas velocity inside the apparatus at a specific location (x2).

Figure 7:
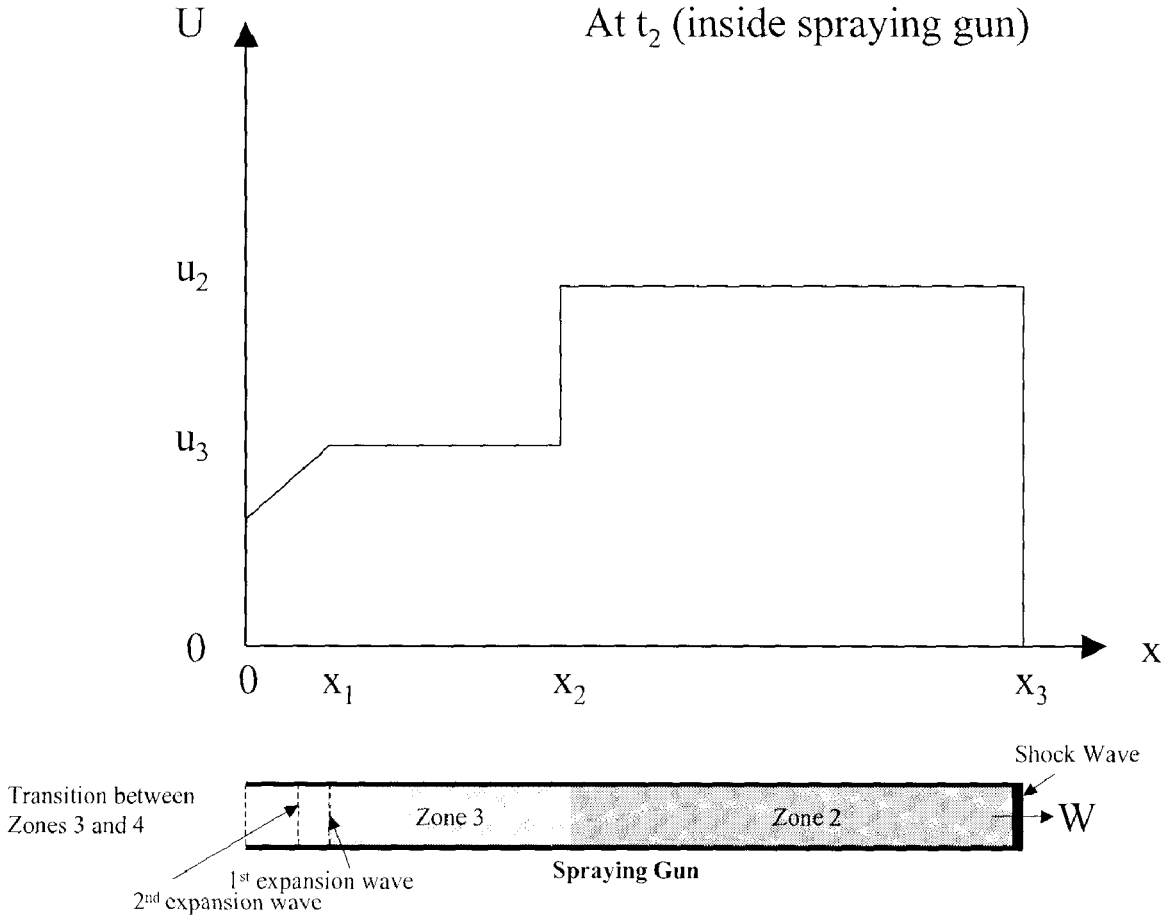

FIG. 7 presents one example of a velocity-position (u-x) diagram illustrating schematically the position-dependant gas velocity inside the apparatus at a specific time (t2).

Figure 8:
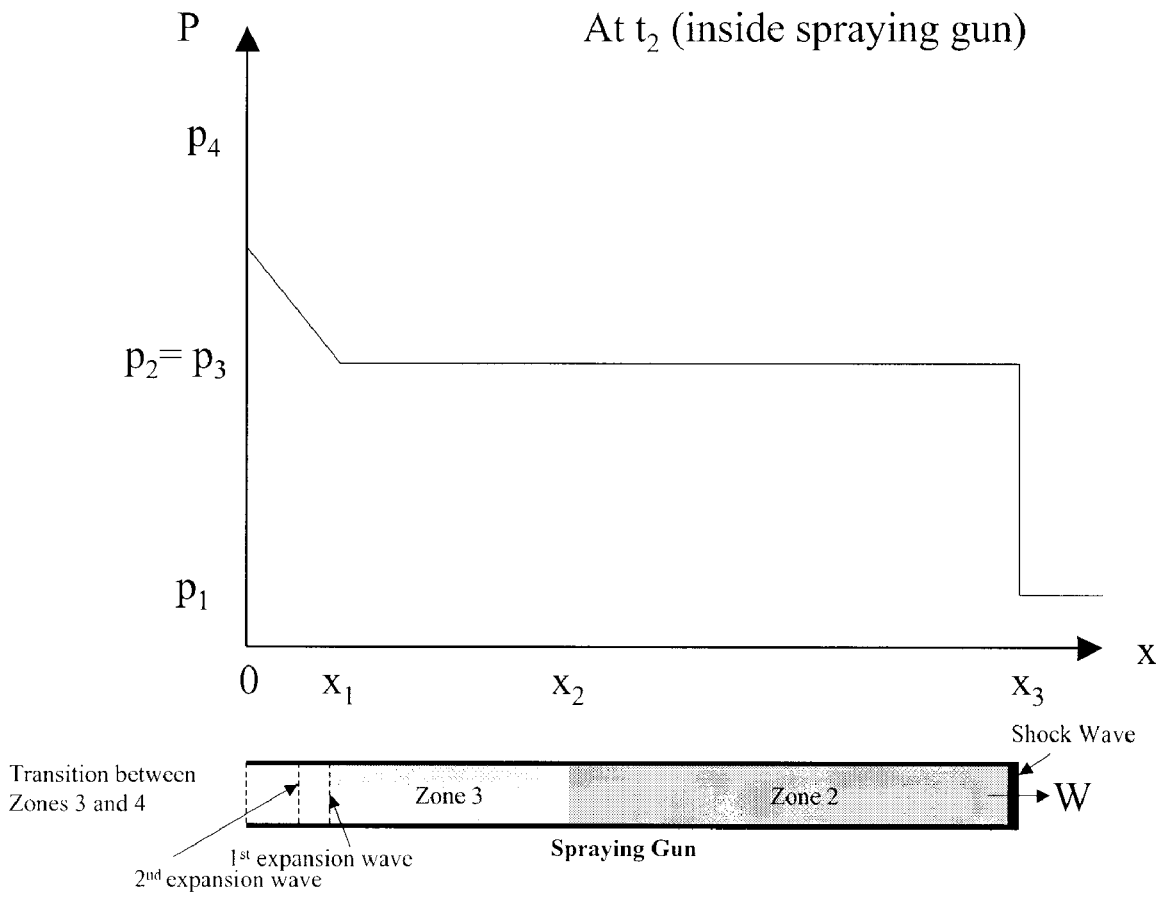

FIG. 8 presents one example of a pressure-position (p-x) diagram illustrating schematically the position-dependant gas pressure inside the apparatus at a specific time (t2).

Figure 9:
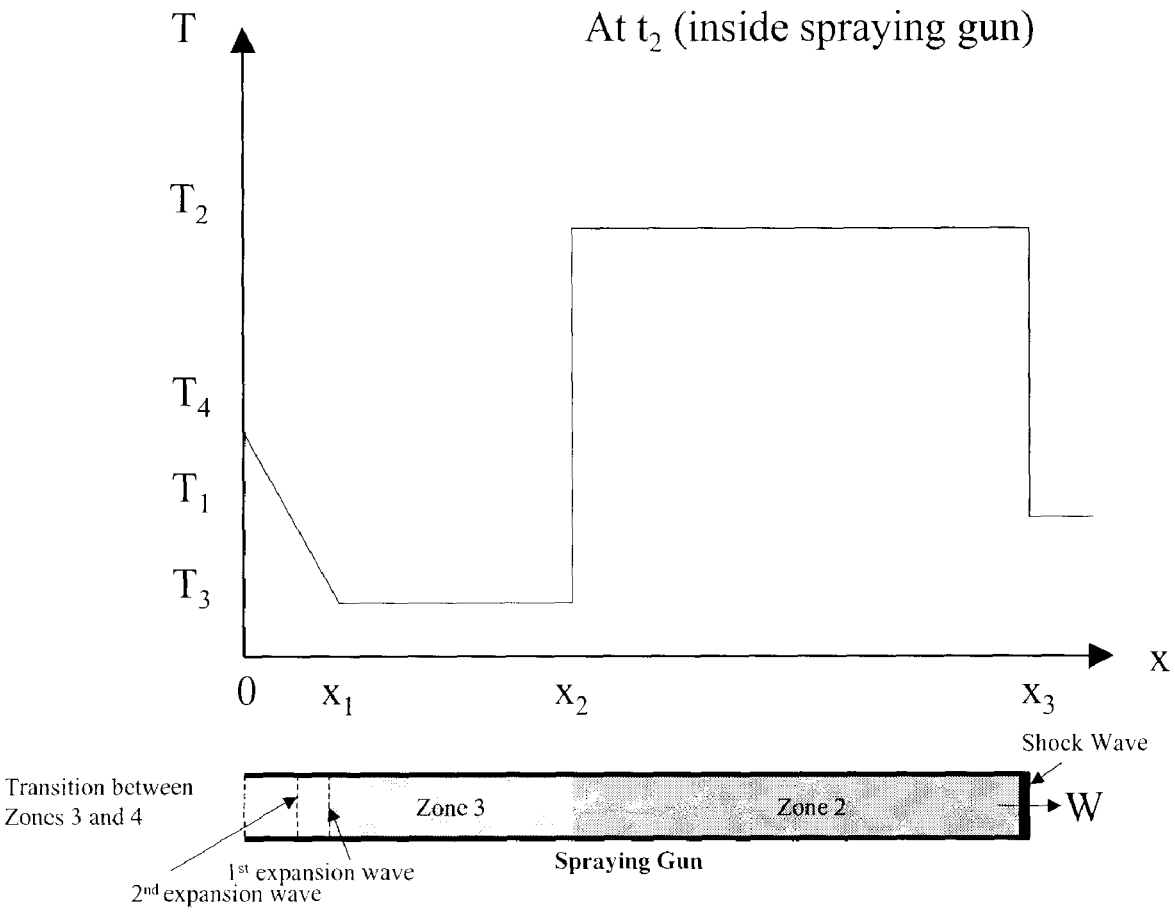

FIG. 9 presents one example of a temperature-position (p-x) diagram illustrating the position-dependant gas temperature inside the apparatus at a specific time (t2).

Example 4

Figure 10:
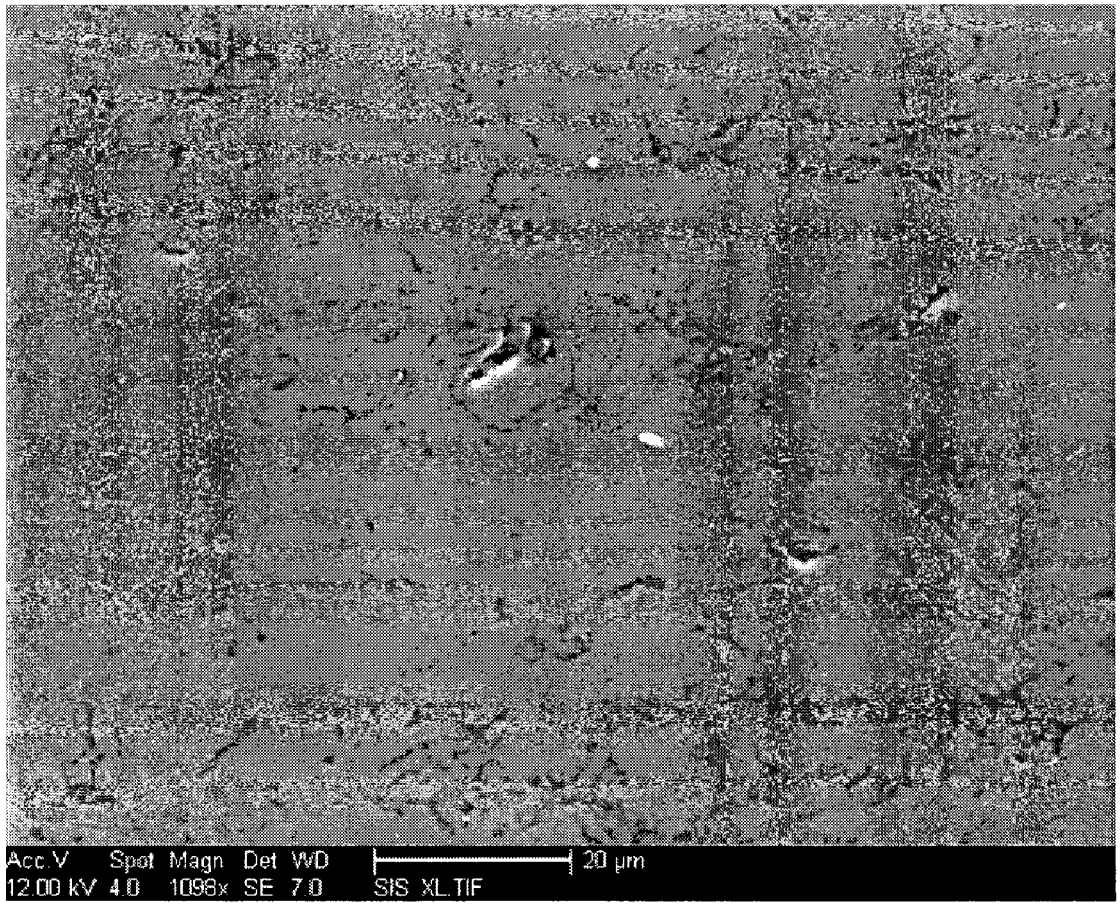

Scanning Electron Microscope Images of Substrate Coatings Generated in Accordance with the Methods of the Present Invention FIG. 10 presents a scanning electron microscopy image of an nanocrystalline aluminum alloy coating on aluminum substrate that was deposited using an apparatus of the invention.

Figure 11:
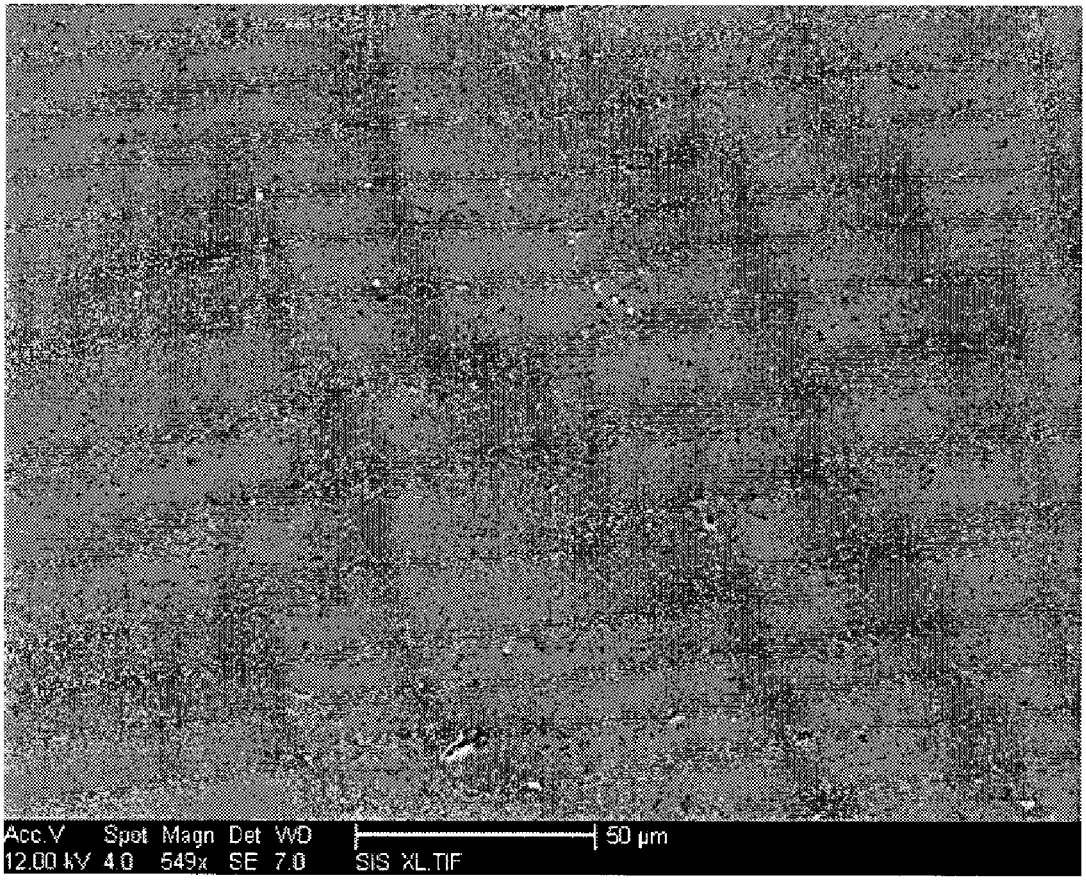

FIG. 11 presents a scanning electron microscopy image of an nanocrystalline aluminum alloy coating on aluminum substrate that was deposited using an apparatus of the invention.

Figure 12:
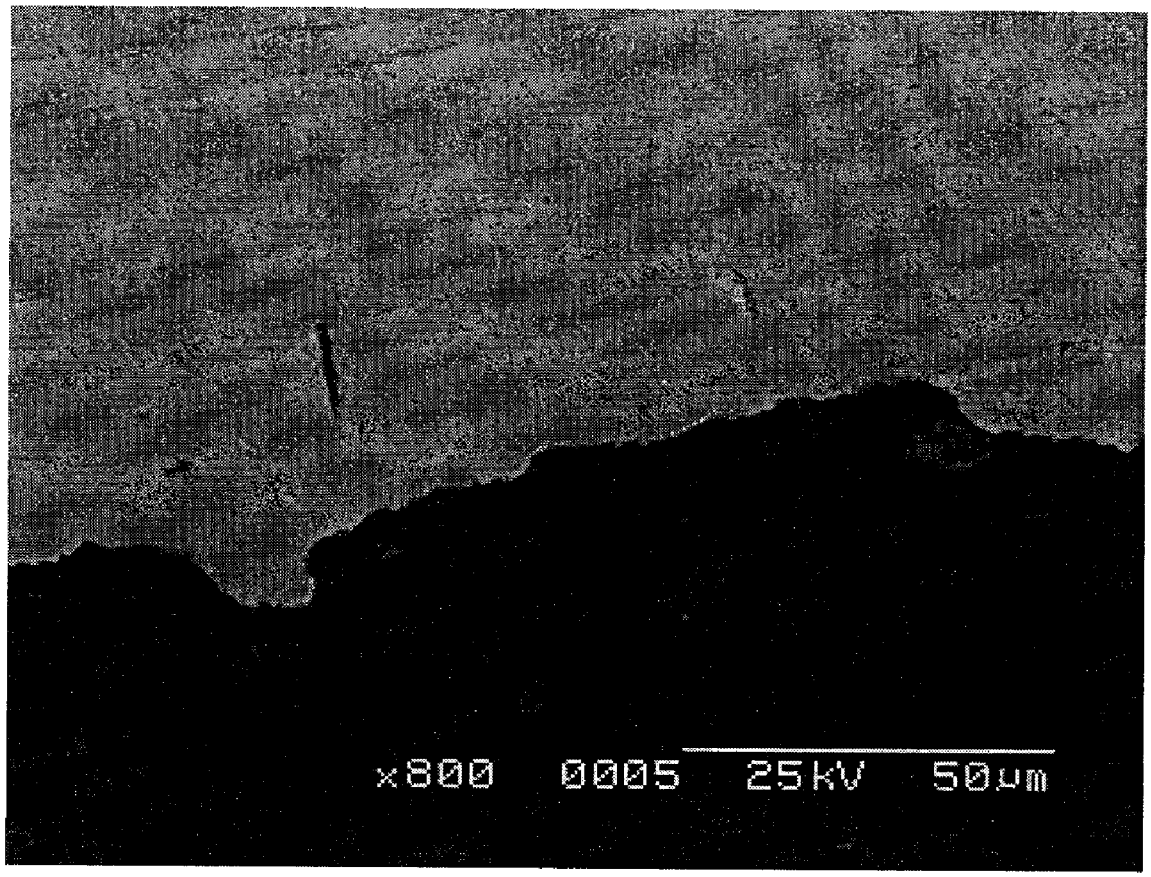

FIG. 12 presents a scanning electron microscopy image of a copper coating on aluminum substrate that was deposited using an apparatus of the invention. (Cu appears as a lighter grey layer, Al appears as a darker grey layer).

Figure 13:
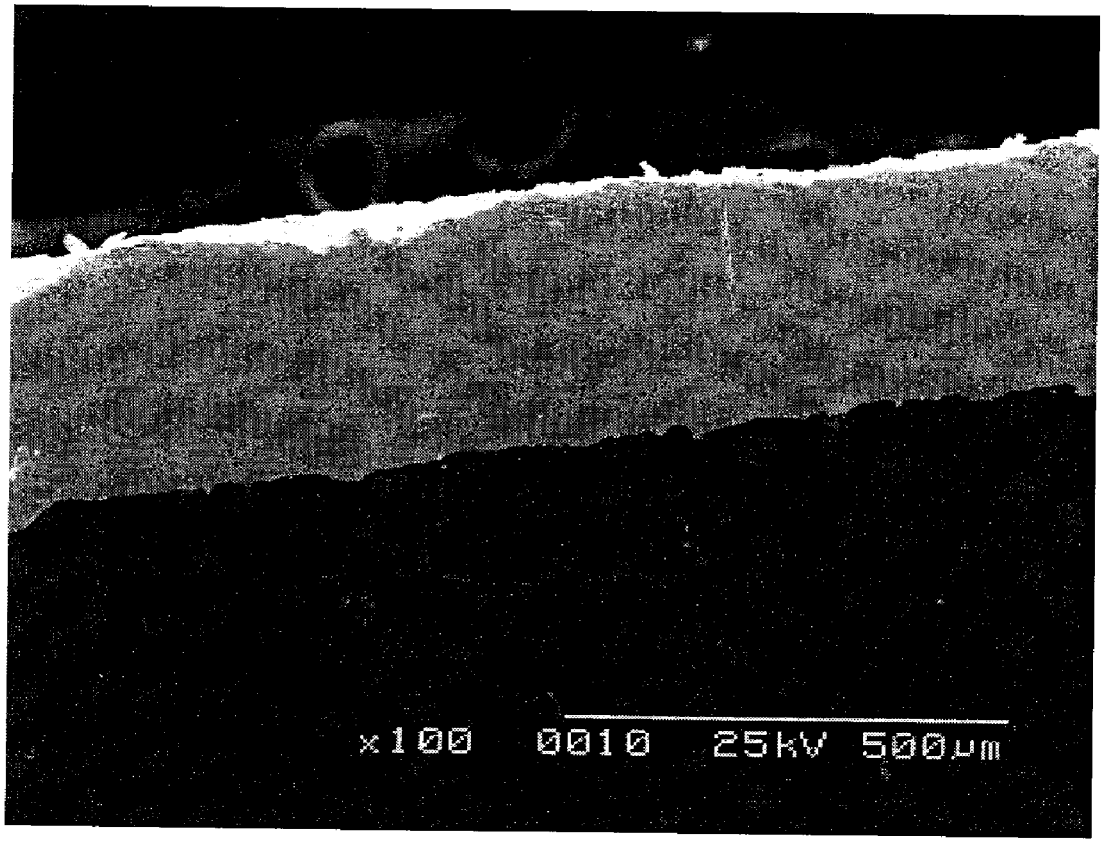

FIG. 13 presents a scanning electron microscopy image of a copper coating on aluminum substrate that was deposited using an apparatus of the invention. (Cu appears as a lighter grey layer, Al appears as a darker grey layer).

Copper, aluminium alloys, nickel, titanium, and hydroxyapatite are examples of materials that have been sprayed successfully using the apparatuses and methods of the invention.

From FIGS. 10 to 13, it can be noted that the coatings generated in accordance with the methods of the present invention are substantially uniform in their structure, have a high density, and exhibit little or no porosity either within the deposited material or at the interface between the deposited material and the surface of the substrate.

Example 5

Typical methods of the Present Invention

Figure 14:
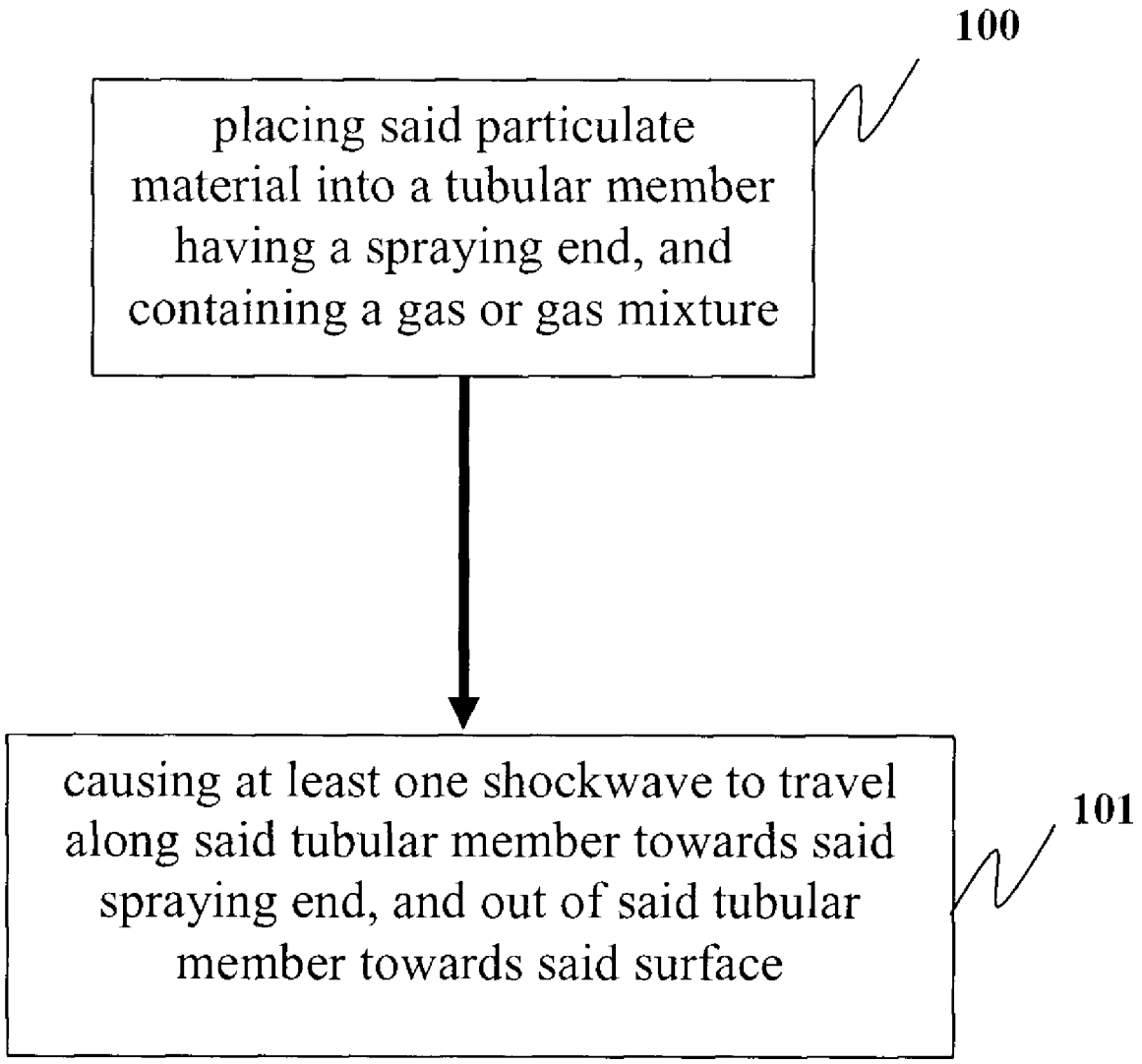
FIG. 14 illustrates a preferred method of the present invention.

FIG. 14 illustrates schematically a typical method of the present invention. The method is for depositing a particulate material onto a surface of a substrate, such that upon or following deposition the particulate material at least in part fuses to said surface and/or to itself to form a solid mass or coating. As illustrated, the method comprises step 100 of placing said particulate material into a tubular member having a spraying end, and containing a gas or gas mixture; and step 101 of causing at least one shockwave to travel along said tubular member towards said spraying end, and out of said tubular member towards said surface, at least some of said particulate material travelling with or near said shock wave and being projected onto said surface at a velocity sufficient to cause upon impact with said surface at least partial deformation of said particulate material and/or said surface.

Figure 15:
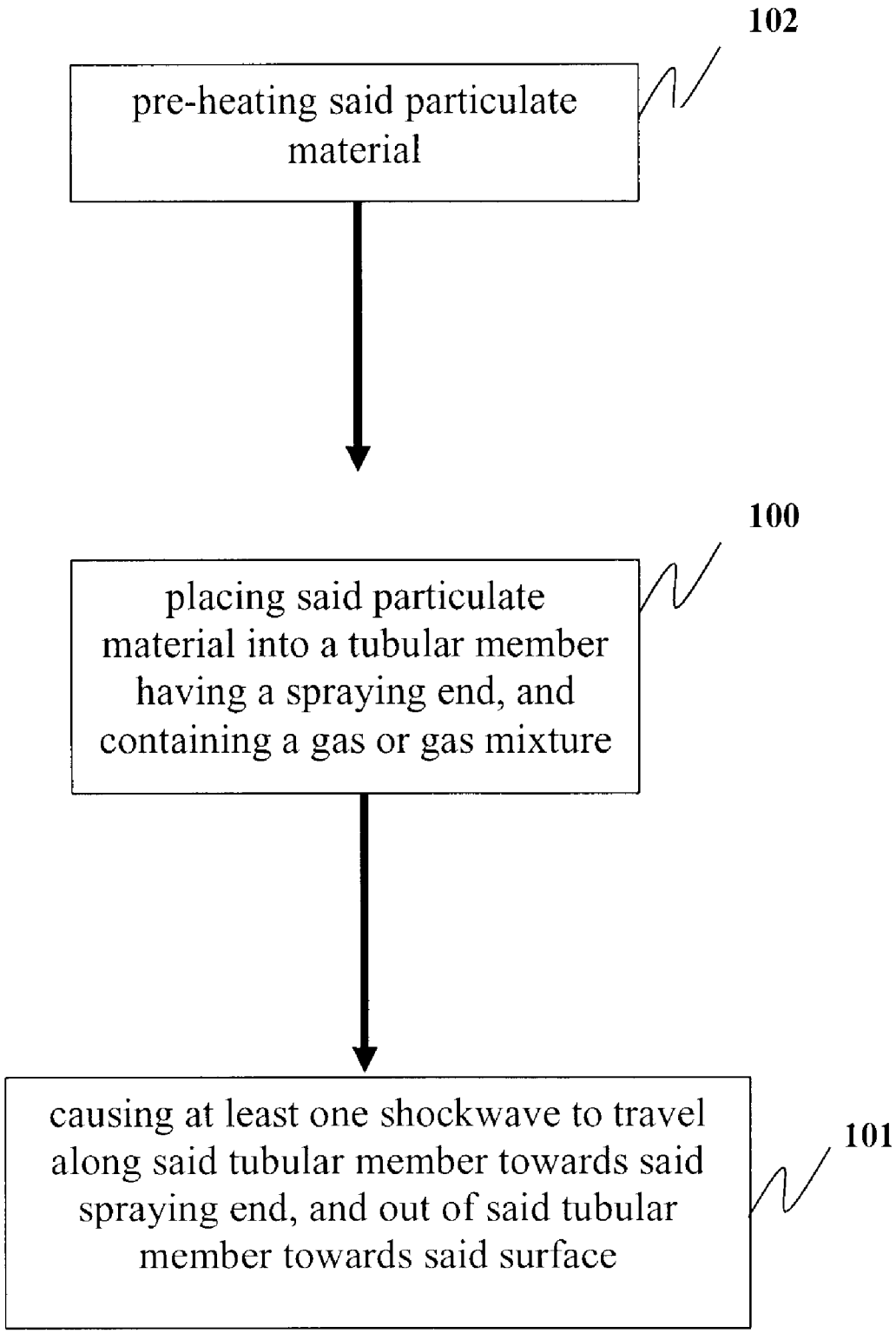
FIG. 15 illustrates a preferred method of the present invention.

A preferred method of the invention is shown in FIG. 15. This method is similar if not identical to that shown in FIG. 14, with the exception of additional step 102. In step 102, the particulate material is pre-heated prior to step 100 of placing the particulate material into the tubular member. Preferably, the pre-heating heats the particulate material without causing melting of the particulate material. More preferably, the pre-heating heats the particulate material to from 100° C. to 1200° C. In other embodiments of the invention (not shown) the step 102 of pre-heating the particulate material may occur between step 100 and 101, or simultaneously with step 100.

Additional methods, additional steps, and further embodiments will be apparent from reading the specification as a whole.

Example 6

Further Scanning Electron Microscope Images of Substrate Coatings Generated in Accordance with the Methods of the Present Invention FIG. 16 presents a scanning electron microscopy image of an nanocrystalline aluminum alloy coating that was deposited using an apparatus of the invention.

FIG. 17 presents a scanning electron microscopy image of an nanocrystalline aluminum alloy (Al-12Si) coating that was deposited using an apparatus of the invention.

Example 7

Average Particle Velocity, as Measured by a Commercial Laser Diagnostic System

A study was conducted to measure a velocity of particulate material being ejected from an apparatus of the present invention. A commercial laser diagnostic system was employed for this purpose. Table 5 below provides the results of 7 separate trials:

TABLE 5

| Measurement trial number | Average particle velocity |
|---|---|
| 1 | 605 m/s |
| 2 | 707 m/s |
| 3 | 698 m/s |
| 4 | 691 m/s |
| 5 | 701 m/s |
| 6 | 705 m/s |
| 7 | 718 m/s |

Example 8

Optical Microscope Image of Substrate Coatings Generated in Accordance with the Methods of the Present Invention, in which the Particulate Material was Pre-Heated Prior to Entry in a Tubular Member or Spray Gun of the Apparatus of the Present Invention FIG. 18 presents an optical microscope image of a stainless steel coating produced form amorphous stainless steel powder that was deposited onto a substrate of Aluminum using an apparatus of the invention. The stainless steel powder was pre-heated prior to insertion into the spraying gun to 350-400° C. The powder was then injected into the spraying gun before it had time to substantially cool, and was rapidly subjected to a shockwave to eject the powder from the spray gun and onto the surface of the substrate of Aluminum. Note that the upper, darker grey layer comprises stainless steel particles compacted to form a substantially uniform layer devoid or virtually devoid of spaces. Formation of such a layer of stainless steel is difficult or virtually impossible to achieve using the methods of the present invention without pre-heating the stainless steel powder.

At the interface between the stainless steel layer (darker grey) and the aluminum substrate (lighter grey) are a few stainless steel particles that did not deform upon impact with the aluminum substrate. Rather, these particles became embedded or partially embedded in the softer upper layers of the aluminum substrate. However, as the stainless steel layer began to form, the impact of the stainless steel particles presumably resulted in deformation and fusion of the particles to form the layer shown (darker grey).

Whilst the present invention has been described with specific reference to certain embodiments and examples, the scope of the invention is in no way limited thereto. Additional apparatuses and methods for deposition of powder or particulate material are within the scope of the invention.

The invention claimed is:

1. A method for depositing a particulate material onto a surface, such that upon or following deposition the particulate material at least in part fuses to said surface and/or to itself to form a solid mass or coating on the surface, the method comprising the steps of:

(1) placing said particulate material into a tubular member having a spraying end, and containing a gas or gas mixture;

(2) causing at least one shockwave to travel along said tubular member towards said spraying end, and out of said tubular member towards said surface, at least some of said particulate material travelling with or adjacent said shock wave and being projected onto said surface at a velocity sufficient to cause upon impact with said surface at least partial deformation of said particulate material and/or said surface, and fusion with said surface and/or particulate material that has already been deposited on said surface, if present, wherein the shockwave is generated by a shockwave generator comprising a chamber and a valve, the chamber containing a gas or gas mixture having a pressure that is higher than a pressure of said gas or gas mixture in said tubular member, the gas or gas mixture in the chamber being released into said tubular member by opening the valve between the shockwave generator and the tubular member, thereby to generate said shockwave in said tubular member; and (3) optionally repeating steps (1) and (2) to deposit said material in a series of pulses.

2. The method of claim 1, wherein prior to the step of causing said at least one shock wave to travel along said tubular member, the method further comprises the step of:

heating said particulate material and/or said gas or gas mixture, either before or after the step of placing said particulate material into said tubular member, preferably to a temperature of from 20 to 1200° C.

3. The method of claim 2, wherein the step of heating comprises heating said particulate material to a temperature sufficient to ensure a ductility and/or malleability of particles of said particulate material to a degree sufficient to allow deformation and/or fusion of the material upon impact with said surface, but insufficient to cause melting or partial melting of said particles.

4. The method of claim 1, wherein said passage of said at least one shockwave along said tubular member causes heating of said gas or gas mixture at or adjacent said shockwave, thereby to heat said particulate material.

5. The method of claim 1, wherein the particulate material exiting said spraying end has at least one characteristic selected from:

a speed of from about 200 m/s to about 1500 m/s; and a temperature of from about 20° C. to about 1200° C.

6. The method of claim 1, wherein the step of placing comprises injecting said particulate material through a wall of said tubular member, and into a lumen of said tubular member, preferably at or near to a time of said passage of said shockwave along said tubular member.

7. The method of claim 1, wherein said surface and said tubular member are movable relative to one another to allow deposition of said material over a desired area or region of said surface.

8. The method of claim 1, wherein said particulate material comprises a metal, a metal alloy, a ceramic, a cermet, a polymer, an amorphous material, a nanocrystalline material, copper, aluminium, nickel, zinc, WC—Co, WC—CoCr, CoNiCrAlY, Al12Si, Al12Si+SiC, PEEK or hydroxyapatite.

9. The method of claim 1, wherein the surface comprises a metal, a metal alloy, a ceramic, a cermet, or a polymer.

10. The method of claim 1, wherein the tubular member has a substantially uniform cross-section along its length.

11. The method of claim 1, wherein prior to said releasing, said gas or gas mixture in said chamber has a pressure of from about 200 kPa and about 20 MPa.

12. The method of claim 1, wherein said gas or gas mixture in said tubular member has a pressure at or near atmospheric pressure.

* * * * *